US010611006B2

(12) United States Patent
Guo

(10) Patent No.: US 10,611,006 B2
(45) Date of Patent: Apr. 7, 2020

(54) LOCKABLE TORQUE WRENCH PROVIDING ACOUSTIC INDICATION

(71) Applicant: CHIA MIN PRECISION INDUSTRIAL CO., LTD., Taichung (TW)

(72) Inventor: Wun-Jin Guo, Taichung (TW)

(73) Assignee: CHIA MIN PRECISION INDUSTRIAL CO., LTD., Taichung (TW)

( * ) Notice: Subject to any disclaimer, the term of this patent is extended or adjusted under 35 U.S.C. 154(b) by 108 days.

(21) Appl. No.: 15/872,372

(22) Filed: Jan. 16, 2018

(65) Prior Publication Data

US 2019/0084135 A1 Mar. 21, 2019

(30) Foreign Application Priority Data

Sep. 18, 2017 (TW) ..... 106131997 A

(51) Int. Cl.
*B25B 23/142* (2006.01)
*B25B 13/46* (2006.01)
*B25B 23/16* (2006.01)

(52) U.S. Cl.
CPC ..... *B25B 23/1427* (2013.01); *B25B 13/463* (2013.01); *B25B 23/16* (2013.01)

(58) Field of Classification Search
CPC ... B25B 23/1427; B25B 13/463; B25B 23/16; B25B 23/1425; B25B 13/461; B25B 13/481; B25B 23/142; B25B 23/1477
See application file for complete search history.

(56) References Cited

U.S. PATENT DOCUMENTS 6,948,410 B1 * 9/2005 Larson ..... B25B 23/1427 173/176
2014/0202292 A1 * 7/2014 Chen ..... B25B 13/463 81/478

FOREIGN PATENT DOCUMENTS

TW M515937 1/2016

* cited by examiner

*Primary Examiner* — Robert J Scruggs
(74) *Attorney, Agent, or Firm* — WPAT, PC

(57) ABSTRACT

A lockable torque wrench providing acoustic indication includes a main shaft, a handle tube, a first cleat, a locking ring, a second cleat, a clip, and a torque-adjusting component. The handle tube is mounted around the main shaft, and the locking ring is rotatably mounted around the handle tube. The first cleat is movably provided between the locking ring and the handle tube. The second cleat is movably provided between the main shaft and the locking ring. The torque-adjusting component is located between the main shaft and the handle tube. Thereby, a user can rotate the locking ring to lock or release the main shaft and the handle tube with respect to each other. When the two are released for torque adjustment of the torque wrench, the second cleat pushes the clip to impact the locking ring, thereby generating acoustic indication for the current torque level.

10 Claims, 7 Drawing Sheets

LOCKABLE TORQUE WRENCH PROVIDING ACOUSTIC INDICATION

BACKGROUND OF THE INVENTION

1. Field of the Invention

The present invention relates to torque wrenches, and more particularly to a lockable torque wrench capable of providing acoustic indication.

2. Description of the Related Art

A torque wrench known in the art, such as the one disclosed in Taiwan Patent No. M515937, has a locking ring that includes a main body comprising an inner tube, an outer tube that is mounted around the inner tube and has two positioning members as well as a limiting member, and a locking ring mounted around the outer tube. The locking ring comprises an inner locking ring and an outer locking ring mounted around the inner locking ring. The inner locking ring at its inner peripheral wall formed with two passing recesses each corresponding to one said positioning member. Each of the passing recesses has its depth increasing as it extends along the inner peripheral wall of the inner locking ring. Besides, the inner locking ring has a limiting recess corresponding to the limiting member. The limiting recess has two retaining blocks, so that when the locking ring rotates with respect to the main body, the limiting member selectively engages with one of the retaining blocks. In addition, the inner locking ring has a plurality of engaging blocks raised from its outer periphery to engage with a plurality of engaging recesses formed on the inner periphery of the outer locking ring. With the foregoing configuration, the relative position between inner tube and the outer tube can be fixed or released by rotation of the locking ring, thereby adjusting the torque wrench in terms of torque.

The prior-art torque wrench is provided with numerals on the outer tube for indicating the current torque level. This allows a user to be aware of the current torque level when he/she performs torque adjustment. However, these indicative numerals on the outer tube tend to blur or be worn after extended use of the torque wrench, and in such a case, a user has no way to learn the current torque level during adjustment, thus lessening convenient in use.

SUMMARY OF THE INVENTION

In order to address the shortcomings of the prior art, the present invention provides a lockable torque wrench capable of providing acoustic indication. During torque adjustment, the wrench has its second cleat push its clip, which in turn impacts the inner wall of the locking ring, thereby generating acoustic indication to inform its user of the current torque level, thereby providing convenient operation of the torque wrench.

For achieving the aforementioned objective, in one embodiment of the present invention, a lockable torque wrench capable of providing acoustic indication comprises: a main shaft, having a first end and a second end, the first end having a driving portion, and the second end having its outer periphery being peripherally provided with a plurality of positioning grooves; a handle tube, being mounted around the second end of the main shaft, the handle tube having its outer periphery being formed with a first recess and a second recess, the first recess and the second recess extending along a lengthwise direction of the handle tube, and the first recess and the second recess corresponding to each of the positioning grooves, respectively; a first cleat, being movably installed in the first recess; a locking ring, being mounted around the handle tube and configured to rotationally move between a locking position and a releasing position with respect to the handle tube, the locking ring having its inner periphery formed with an acting recess corresponding to the first cleat; a second cleat, being movably installed between the second recess and the main shaft; a clip, being mounted around an outer periphery of the second cleat; and a torque-adjusting component, being located between the main shaft and the handle tube, wherein when the locking ring is in the locking position, the first cleat is retained between one of the positioning grooves and the acting recess, and the second cleat is retained between one of the positioning grooves and the locking ring; and when the locking ring is in the releasing position, the first cleat is allowed to move between the positioning groove and the acting recess, so that the handle tube can be rotated to make adjustment of the torque-adjusting component in terms of torque level, in which when the second cleat moves from the positioning groove to the outer periphery of the second end, the clip is pushed to impact an inner wall of the locking ring, thereby generating the acoustic indication.

Thereby, when the locking ring is rotated to the releasing position, the handle tube is allowed to be rotated to set the torque level of the torque wrench. During the torque adjustment, the second cleat pushes the clip to impact the inner wall of the locking ring and generate acoustic indication for a user to hear and be informed of the current torque level. The present invention thus eliminates the problem about the conventional numeral torque indication that tends to degenerate under external damage and over extended use, thereby allowing convenient use of a torque wrench.

Furthermore, the present invention allows a user to make switch with his/her single hand, so is more convenient to use as compared to the known devices. Besides, the present invention employs simple components to make uncomplicated combination, thereby providing advantages of low manufacturing costs and easy fabrication.

DETAILED DESCRIPTION OF THE INVENTION

Figure 1:
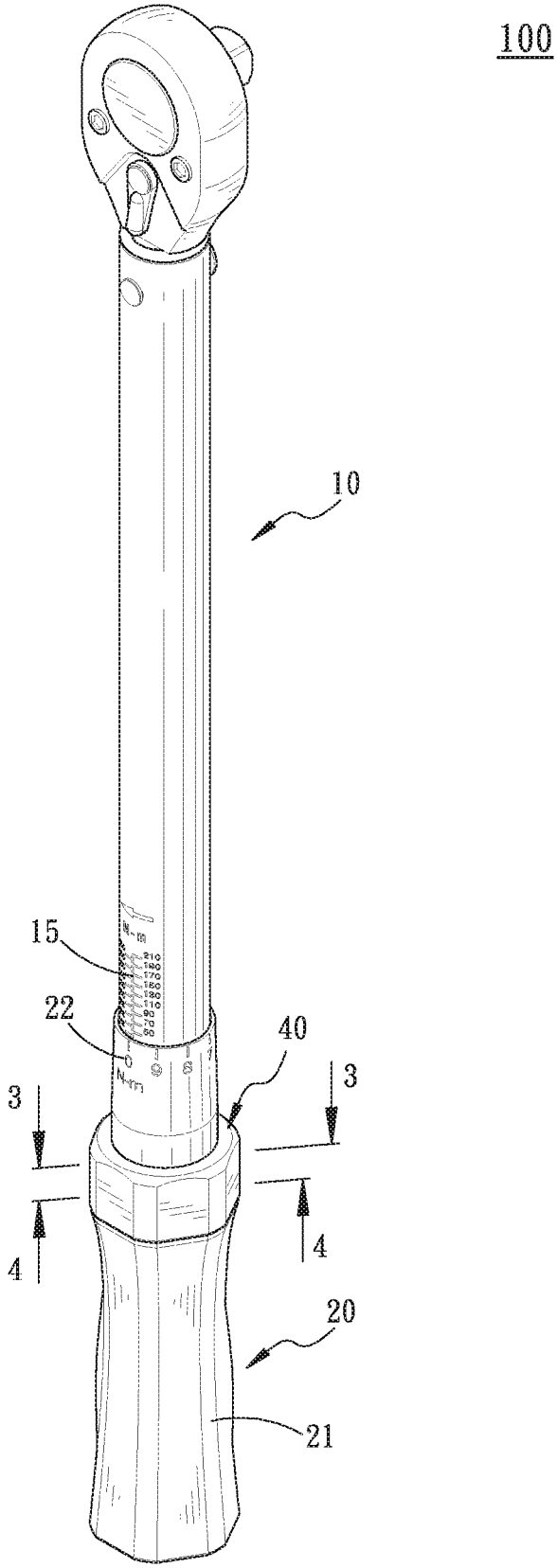
FIG. 1 is a perspective view of the present invention.

The following preferred embodiments when read with the accompanying drawings are made to clearly exhibit the above-mentioned and other technical contents, features and effects of the present invention. Through the exposition by means of the specific embodiments, people would further understand the technical means and effects the present invention adopts to achieve the above-indicated objectives. However, the accompanying drawings are intended for reference and illustration, but not to limit the present invention and are not made to scale.

It is to be noted that where it is stated that one element is "deposited on or fixed to "another element, the description is intended to mean that the first element is directly mounted on the second element, or the first element is connected to the second element through one or more intermediary elements. By comparison, where it is stated that one element is deposited "directly" on another element, there is no any intermediary elements between them. The use of terms such as "a" and "at least one" are not intended to specify a certain form of quantity, but illustratively recites one possible embodiment of the present invention.

Referring to FIG. 1 through FIG. 7, the disclosed lockable torque wrench 100 capable of providing acoustic indication comprises a main shaft 10, a handle tube 20, a first cleat 30, a locking ring 40, a second cleat 50, a clip 60, and a torque-adjusting component 70. Therein, the locking ring 40 is configured to be rotated between a locking position and a releasing position, for locking the main shaft 10 with respect to the handle tube 20, or for allowing the handle tube 20 to be rotated and thereby operate the torque-adjusting component 70 to adjust a torque level of the lockable torque wrench 100. During adjustment of the torque level, the second cleat 50 pushes the clip 60 to hit the inner wall of the locking ring 40, thereby generating an acoustic indication.

The main shaft 10 has a first end 11 and a second end 12 that are opposite to each other. The first end 11 has a driving portion 13. The driving portion 13 may be in the form of a ratchet socket adapter, for receiving a workpiece. The outer periphery 121 of the second end 12 is peripherally provided with a plurality of positioning grooves 14 that are concavely disposed in intervals. The positioning grooves 14 extend along the lengthwise direction of the main shaft 10. Additionally, the outer periphery of the main shaft 10 is peripherally provided with a plurality of torque graduations 15 located between the first end 11 and the second end 12.

The handle tube 20 has its one end mounted around the second end 12 of the main shaft 10. The handle tube 20 has its one end formed with a grip portion 21, and an opposite end, i.e. the end connecting the second end 12 of the main shaft 10 provided with a plurality of torque level values 22. Each of the torque level values 22 corresponds to one of the positioning grooves 14. Therein, a first recess 23 and a second recess 24 are formed between the grip portion 21 and the torque level values 22. The first recess 23 and the second recess 24 extend along the lengthwise direction of the handle tube 20. The first recess 23 has a length with respect to the lengthwise direction of the handle tube 20 that is greater than the length of the second recess 24 with respect to the lengthwise direction of the handle tube 20. The first recess 23 and the second recess 24 are offset from each other. Therein, the bottom of the first recess 23 is above the top of the second recess 24, and the first recess 23 and the second recess 24 correspond to different said positioning grooves 14, respectively. In the embodiment, the first recess 23 and the second recess 24 are both in lengthwise rectangular shapes.

The first cleat 30 is movably installed in the first recess 23. The first cleat 30 has a first end portion 31 and a second end portion 32 that are opposite to each other. The first end portion 31 and the second end portion 32 are connected by a trunk portion 33. The trunk portion 33 is parallel to the lengthwise direction of the handle tube 20. In the embodiment, the first cleat 30 is cylindrical.

The locking ring 40 is mounted around the handle tube 20, and is configured to rotate about an axial direction of the handle tube 20 with respect to the handle tube 20 between a locking position and a releasing position. The locking ring 40 is axially formed with a through hole 41. The through hole 41 has a first hole section 411 and a second hole section 412, so is stepped. The first hole section 411 has a hole diameter smaller than the hole diameter of the second hole section 412. Therein, the second hole section 412 has a straight inner wall. In the embodiment, the locking ring 40 is made of metal.

Referring to FIG. 2, FIG. 3, FIG. 5, and FIG. 6, the inner wall of the first hole section 411 is partially depressed to form an acting recess 42 that is aligned with and receives the first cleat 30. The acting recess 42 has a first depression 421 and a second depression 422. The first depression 421 and the second depression 422 border each other and are formed along the inner periphery of the locking ring 40. In addition, the second depression 422 has a depth against the inner periphery of the locking ring 40 greater than the depth of the first depression 421 against the inner periphery of the locking ring 40. The inner profile of the first depression 421 is formed in a shape identical to the shape of the inner profile of the second depression 422 and the outer profile of the first cleat 30. When the locking ring 40 is in the locking position, the first depression 421 is aligned with the first cleat 30, so that the first cleat 30 is retained between the positioning groove 14 and the first depression 421 of the acting recess 42. When the locking ring 40 is rotated to the releasing position, the second depression 422 is allowed to receive each of the first cleats 30, so that when the handle tube 20 is rotated for adjusting the torque level, the first cleat 30 is allowed to move between the positioning groove 14, the outer periphery 121, and the second depression 422 of the acting recess 42.

Additionally, the locking ring 40 has a polyhedral outer periphery for convenient manual operation. Also, the outer periphery of the handle tube 20 is polyhedral. The outer periphery of each of the handle tube 20 and the locking ring 40 is substantially composed of a plurality of planes and a plurality of edges. Therein, the locking ring 40, in either of the foregoing positions switched by rotation, has the planes and the edges on its outer periphery aligned with the planes and the edges on the outer periphery of the handle tube 20.

Figure 2:
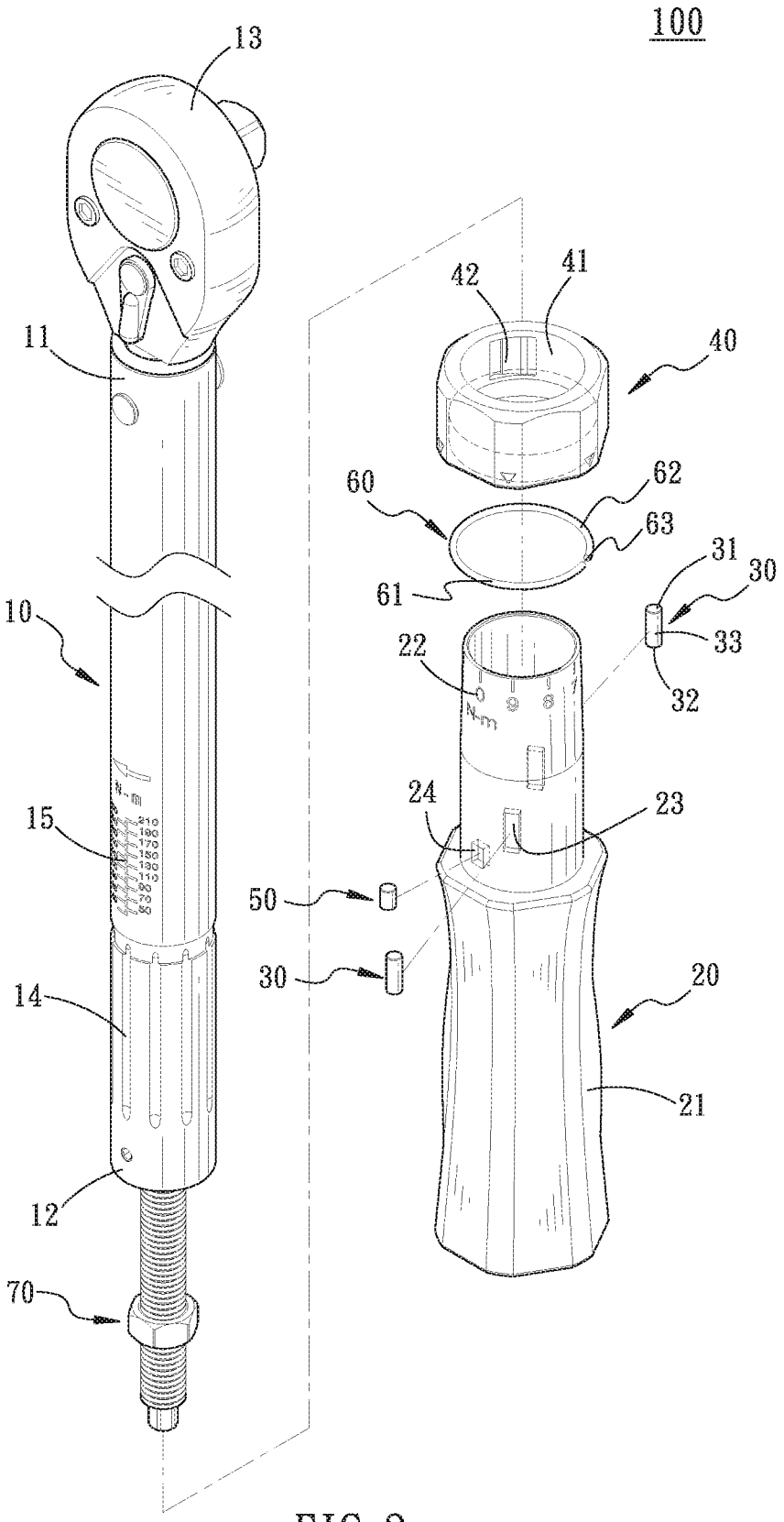
FIG. 2 is an exploded view of the present invention.
Figure 3:
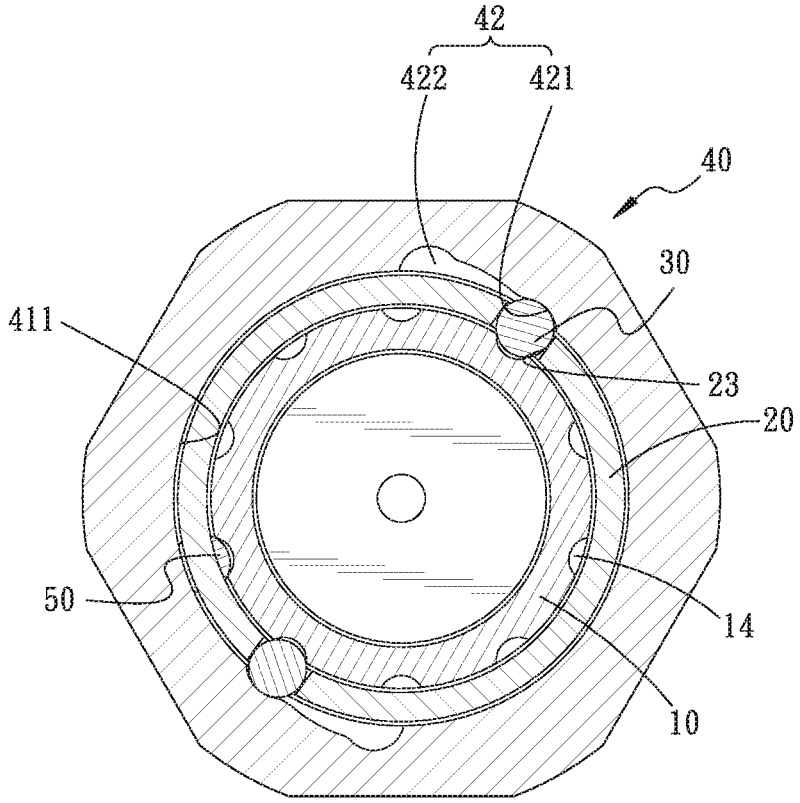
FIG. 3 is a cross-sectional view of the present invention taken along line 3-3 in FIG. 1, showing that the locking ring is in the locking position and the first cleat is retained between the locking ring and the handle tube.
Figure 4:
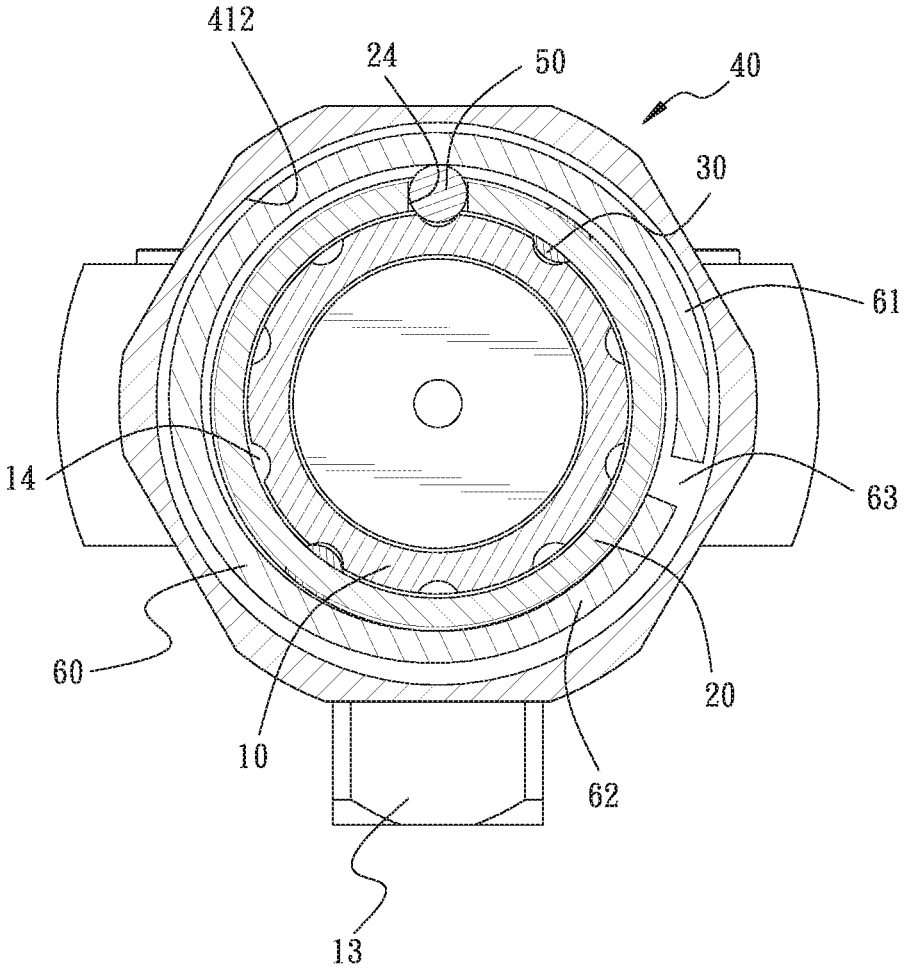
FIG. 4 is a cross-sectional view of the present invention taken along line 4-4 in FIG. 1, showing that the locking ring is in the locking position and the second cleat is retained between the locking ring and the handle tube.
Figure 5:
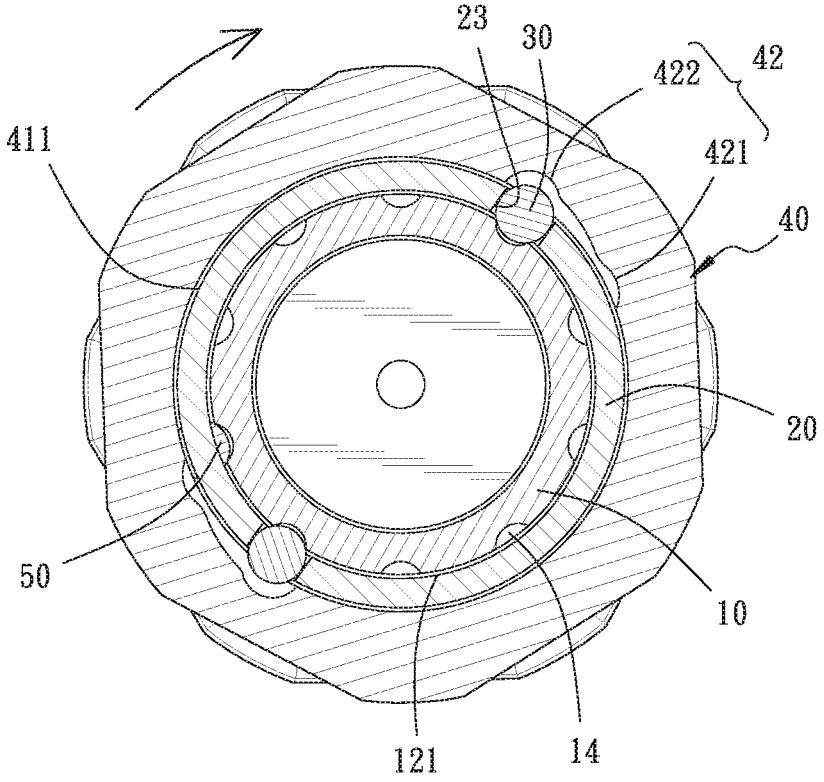
FIG. 5 is a cross-sectional view of the present invention showing that the locking ring is in the releasing position and the first cleat is located between the positioning groove and the second depression of the acting recess.
Figure 6:
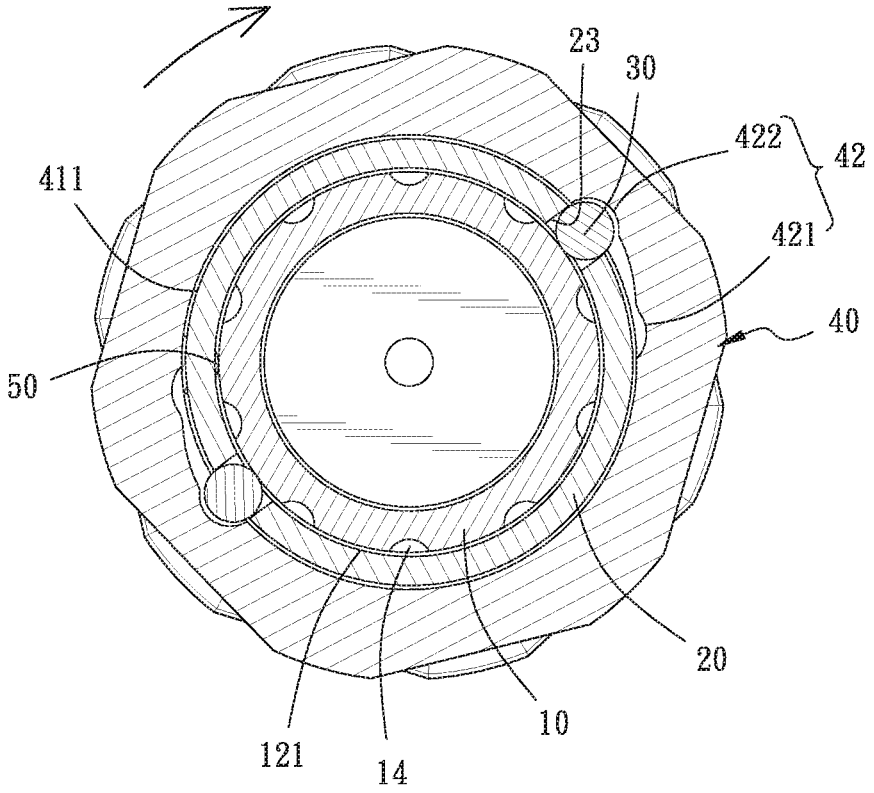
FIG. 6 is another cross-sectional view of the present invention showing that the locking ring is in the releasing position and the handle tube rotates along the direction pointed by the arrowhead with respect to the main shaft for adjusting the torque level value.
Figure 7:
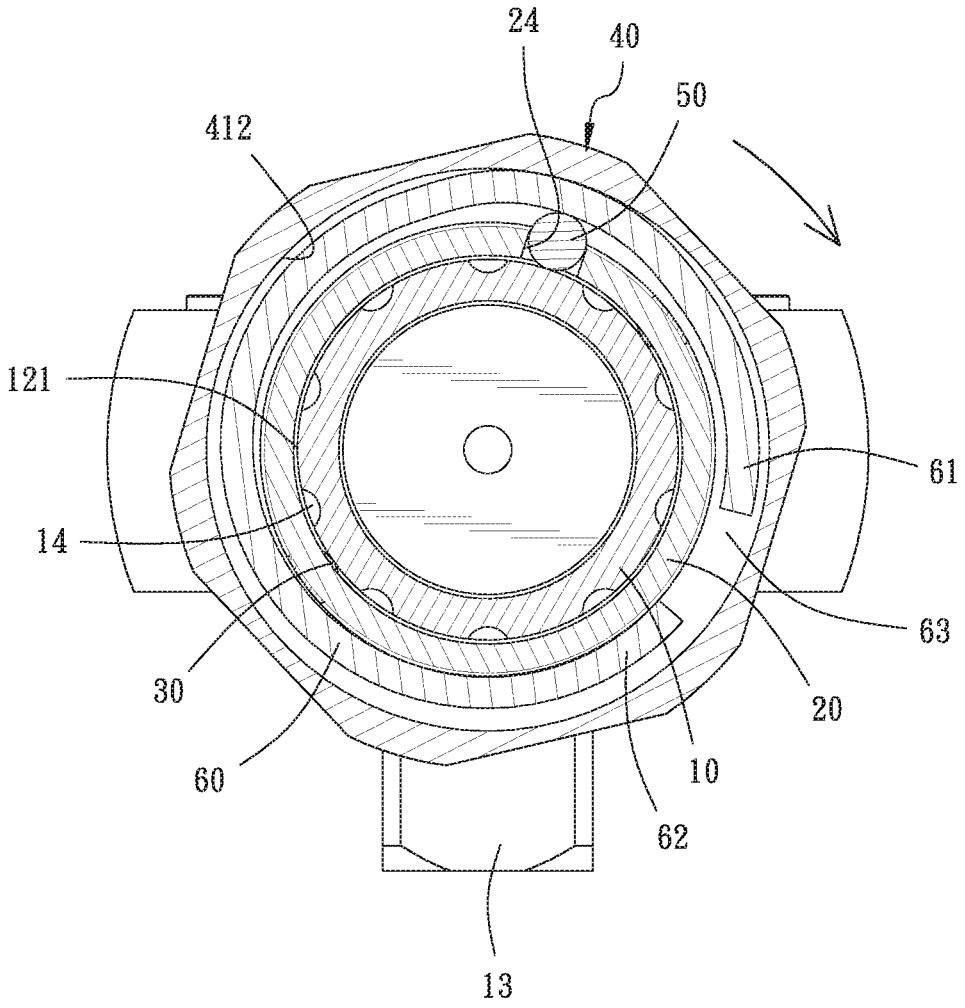
FIG. 7 is another cross-sectional view of the present invention showing that the locking ring is in the releasing position and the second cleat moves to the outer periphery of the main shaft to abut against the clip, such that the clip hits the inner wall of the locking ring, thereby generating an acoustic indication.

The second cleat 50 is movably installed in the second recess 24, between the main shaft 10 and the second hole section 412 of the locking ring 40. In the embodiment, the second cleat 50 is cylindrical. In the locking position, the second cleat 50 is retained between one of the positioning grooves 14 and the locking ring 40. In the releasing position, the handle tube 20 is allowed to be rotated to adjust the preload the torque-adjusting component 70 exerts on the driving portion 13, thereby have the torque level adjusted. The second cleat 50, with the rotation adjustment of the handle tube 20, moves from the foregoing positioning groove 14 to the outer periphery 121 of the second end 12 together, and then moves to the adjacent said positioning groove 14, as shown in FIG. 2, FIG. 4, and FIG. 7.

The clip 60 is mounted around the outer periphery of the second cleat 50 and is located at the second end 12 of the main shaft 10, between the second cleat 50 and the inner side of the locking ring 40. The clip 60 has a first contact section 61 and a second contact section 62. The first contact section 61 has its one end connected to one end of the second contact section 62. The opposite end of the first contact section 61 and the opposite end of the second contact section 62 are separated by an opening 63. The first contact section 61 contacts the outer periphery of the second cleat 50, and the second contact section 62 contacts the outer periphery of the second end 12 of the main shaft 10. The clip 60 is circular. In the embodiment, clip is a C-ring made of metal.

When moving to the outer periphery 121 of the second end 12 from the foregoing positioning groove 14, the second cleat 50 pushes the first contact section 61 of the clip 60 toward the inner wall of the second hole section 412 of the locking ring 40, so that the first contact section 61 of the clip 60 is made to hit the inner wall of the second hole section 412. At this time, impact between the metal clip 60 and the metal locking ring 40 can generate an acoustic indication, and the opening 63 is expanded by the second cleat 50, so the second contact section 62 of the clip 60 abuts against the outer periphery of the second end 12 of the main shaft 10, thereby preventing the clip 60 from moving, as shown in FIG. 2, FIG. 4, and FIG. 7.

The torque-adjusting component 70 is located between the main shaft 10 and the handle tube 20 for adjusting the preload exerted on the driving portion 13. When the locking ring 40 is in the releasing position, the handle tube 20 can be rotated with respect to the main shaft 10, so as to adjust the preload the torque-adjusting component 70 exerts on the driving portion 13, thereby adjusting the torque wrench in terms of torque level. For every time when the handle tube 20 is rotated, the second cleat 50 moves from one of the positioning grooves 14 through the outer periphery 121 to an adjacent said positioning groove 14. As a result of the movement, when the second cleat 50 moves to the outer periphery 121, the clip 60 is pushed to impact the inner wall of the second hole section 412 by the second cleat 50, and an acoustic indication is generated consequently for indicating the current torque level of the torque wrench.

Furthermore, during adjustment of the torque level, the acoustic indication, together with relative position of the torque level value 22 and the torque graduations 15, clearly indicates the current torque level of the torque wrench.

What is special is that during manual adjustment of the torque of the wrench, if the graduations of the torque level values 22 are not aligned with the torque graduations 15 (such as one value is located between two graduations), the handle tube 20 can be fine-tuned so as to set the first cleat 30 in exactly one of the positioning groove 14, and to allow the torque level values 22 and the torque graduations 15 to be well aligned with each other for precise positioning.

Furthermore, in one embodiment of the present invention, the first cleat 30, the acting recess 42 and the first recess 23 are each made in an opposite pair. Therein, the two first recesses 23 are such located on the outer periphery of the handle tube 20 that they are separated from each other by 180 degrees.

With the foregoing configuration, a user can uses his/her single hand to rotationally operate the locking ring 40, so as to make the locking ring 40 rotate with respect to the handle tube 20, thereby making the locking ring 40 move to the releasing position from the locking position. Therein, the first cleat 30 is located between one of the positioning grooves 14 and the second depression 422. Since the depth of the second depression 422 in the inner periphery of the locking ring 40 is greater than the depth of the first depression 421 in the inner periphery of the locking ring 40, when the user rotates the handle tube 20 against the main shaft 10, the first cleat 30 moves between each of the positioning grooves 14 and the second depression 422 of the acting recess 42, thereby preventing the locking ring 40 from holding the first cleat 30 and allowing the handle tube 20 to rotate with respect to the main shaft 10 for torque adjustment of the torque wrench.

When a user adjusts the preload the torque-adjusting component 70 exerts on the driving portion 13 and thereby adjusts the torque wrench in terms of torque level, every time the user rotate the handle tube 20, the second cleat 50 moves from one of the positioning grooves 14 to an adjacent said positioning groove 14. During the foregoing movement, the second cleat 50 first moves to the outer periphery 121 of the second end 12. At this time, the second cleat 50 pushes the clip 60 to impacts the inner wall of the locking ring 40, so as to generate acoustic indication for the user to be aware of the current torque level of the torque wrench.

Thereby, the acoustic indication generated when the clip 60 impacts the inner wall of the locking ring 40 clearly informs the user of the current status of torque adjustment, thereby allowing convenient operation of the torque wrench. In addition, a user can make switch with his/her single hand, making the operation of the torque wrench even more convenient.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A lockable torque wrench capable of providing acoustic indication, the lockable torque wrench comprising:

a main shaft, having a first end and a second end, the first end having a driving portion, and the second end having its outer periphery being peripherally provided with a plurality of positioning grooves that are concavely disposed in intervals;

a handle tube, being mounted around the second end of the main shaft, the handle tube having its outer periphery being formed with a first recess and a second recess, the first recess and the second recess extending along a lengthwise direction of the handle tube, and the first recess and the second recess corresponding to each of the positioning grooves, respectively;

a first cleat, being movably installed in the first recess;

a locking ring, being mounted around the handle tube and configured to rotationally move about an axial direction of the handle tube between a locking position and a releasing position with respect to the handle tube, the locking ring having its inner periphery formed with an acting recess corresponding to the first cleat, the acting recess having a first depression and a second depression, the first depression bordering the second depression along the inner periphery of the locking ring, the second depression having a depth with respect to the inner wall of the locking ring greater than a depth of the first depression with respect to the inner wall of the locking ring, an inner profile of the first depression being formed in a shape identical to a shape of an inner profile of the second depression and an outer profile of the first cleat;

a second cleat, being movably installed in the second recess;

a clip, which is a C-ring, being mounted around an outer periphery of the second cleat and on an inner side of the locking ring; and a torque-adjusting component, being located between the main shaft and the handle tube for adjusting a preload exerted on the driving portion, wherein when the locking ring is in the locking position, the first cleat is retained between one of the positioning grooves and the first depression of the acting recess, and the second cleat is retained between another one of the positioning grooves and the locking ring; and when the locking ring is in the releasing position, the second depression of the acting recess receives the first cleat, so that when the handle tube is rotated to make adjustment of the torque-adjusting component in terms of torque level, the first cleat is allowed to move between the second depression, the outer periphery, and the positioning groove, and the second cleat, with the rotation adjustment of the handle tube, moves from the positioning groove to the outer periphery of the second end, such that the clip is pushed to impact an inner wall of the locking ring, thereby generating the acoustic indication for one time.

2. The lockable torque wrench of claim 1, wherein the locking ring is axially formed with a through hole, and the through hole is stepped.

3. The lockable torque wrench of claim 2, wherein the through hole includes a first hole section and a second hole section, the first hole section having a hole diameter smaller than a hole diameter of the second hole section, the acting recess being depressed from an inner wall of the first hole section, and the second hole section being configured to receive the second cleat.

4. The lockable torque wrench of claim 2, wherein the second cleat pushes the clip to impact the inner wall of the second hole section.

5. The lockable torque wrench of claim 1, wherein the clip has a first contact section and a second contact section, the first contact section having one end thereof connected to one end of the second contact section, and an opposite end of the first contact section and an opposite end of the second contact section being separated by an opening.

6. The lockable torque wrench of claim 5, wherein the locking ring is made of metal, and the clip is made of metal.

7. The lockable torque wrench of claim 1, wherein the first recess and the second recess are offset from each other, and the first recess and the second recess correspond to different positioning grooves, respectively.

8. The lockable torque wrench of claim 1, wherein the first cleat, the acting recess and the first recess are each made in an opposite pair, and the two first recesses are such located on the outer periphery of the handle tube that they are separated from each other by 180 degrees.

9. The lockable torque wrench of claim 1, wherein the first cleat and the second cleat are cylindrical.

10. The lockable torque wrench of claim 1, wherein the outer periphery of the locking ring is polyhedral, and the outer periphery of the handle tube is also polyhedral; the outer periphery of each of the handle tube and the locking ring is substantially formed of a plurality of planes and a plurality of edges; the locking ring, in either of the positions switched by rotation, has the planes and the edges on its outer periphery aligned with the planes and the edges on the outer periphery of the handle tube.

* * * * *